United States Patent [19]

Ratliff, Jr.

[11] Patent Number: 4,706,925

[45] Date of Patent: Nov. 17, 1987

[54] METHOD OF STRIPPING AN INGOT FROM A SECTIONAL INGOT MOLD AND AN IMPROVED SECTIONAL INGOT MOLD THEREFOR

[75] Inventor: George D. Ratliff, Jr., Pittsburgh, Pa.

[73] Assignee: USX Engineers & Consultants, Inc., Pittsburgh, Pa.

[21] Appl. No.: 548,059

[22] Filed: Nov. 2, 1983

Related U.S. Application Data

[63] Continuation of Ser. No. 349,400, Feb. 16, 1982, abandoned.

[51] Int. Cl.[4] ..... B22D 7/08

[52] U.S. Cl. ..... 249/162; 164/341

[58] Field of Search ..... 164/131, 341–343, 164/394–396; 249/162, 174

[56] References Cited

U.S. PATENT DOCUMENTS 915,489 3/1909 Schrag ..... 249/162

2,932,075 4/1960 Knight ..... 249/162

4,269,385 5/1981 Bowman ..... 249/82

FOREIGN PATENT DOCUMENTS 533303 11/1956 Canada ..... 164/342

618029 2/1961 Italy ..... 164/342

1772 of 1874 United Kingdom ..... 249/162

*Primary Examiner*—Kuang Y. Lin

*Attorney, Agent, or Firm*—W. F. Riesmeyer, III

[57] ABSTRACT

A method is disclosed for easing stripping of an ingot from a sectional mold without disassembly of the fastened sections, by partially separating the sections during stripping. An improved mold is provided for accomplishing such partial separation of the sections, preferably by translating part of stripping forces applied longitudinally to the mold into a transverse direction, creating a gap between the longitudinal sections. Various means are shown for coaction with movable stripping lugs to apply a separating force to opposed adjacent mold sections.

6 Claims, 5 Drawing Figures

METHOD OF STRIPPING AN INGOT FROM A SECTIONAL INGOT MOLD AND AN IMPROVED SECTIONAL INGOT MOLD THEREFOR

BACKGROUND OF THE INVENTION

This is a present continuation of application Ser. No. 349,400 filed Feb. 16, 1982, now abandoned.

The present invention relates to a method of stripping ingots from sectional ingot molds, and a sectional ingot mold adapted to ease, removal of an ingot from the mold without disassembly thereof.

Ingot molds are cast-iron vessels for containing liquid steel while it solidifies. Typically, such molds have thick sidewalls and various end configurations, including a type which is open at both ends. For the open-bottom type, liquid steel is contained by a close-fitting cast-iron stool that supports the mold. After the steel solidifies, the molds are lifted with a crane and held aloft while a hydraulic ram pushes the ingot out of the mold.

Ingot molds typically develop cracks through the sidewalls early in a campaign i.e. with a relatively few number of pours. The cracks grow in length with each successive pour until they are so large that the mold must be removed from service. Although thermal stresses have long been regarded as the cause of early cracking, it was not until the advent of advanced computers and computer software that reasonably dependable stress analyses could be made. Such an analysis on a typical one-piece mold shows that thermal stresses reached at about ten minutes after casting may exceed the elastic limit of the cast-iron mold material. Thus, it is not reasonable to expect that the life of one-piece molds could be significantly extended. Because of substantial increases in mold costs interest has grown in finding new mold designs capable of longer life.

The standard method of relieving stresses in other applications is with joints. This suggests the possibility of developing a sectional mold for use in steel mills. An indication of the potential for increasing life of commercial molds is the performance of sectional molds commonly used in the research laboratory. These molds have a life of over five hundred pours which is five to ten times the life of commercial one-piece molds. The research mold sections are fastened by metal C-clamps which apparently allow some flexibility and expansion to relieve the imposed thermal stresses. An example of a commercial-size sectional mold is shown in U.S. Pat. No. 4,269,385 Bowman.

It is of course desirable to strip ingots from sectional molds in the same manner as from one-piece molds. Thus, it is of significant advantage if the mold does not require disassembly. However, trials of commercial-size segmented molds have shown that the forces required for stripping are significantly higher. This apparently is due to pressure by the fasteners forcing the sections tightly against the ingot.

It is therefore a primary object of this invention to provide a method of stripping ingots from sectional molds, which significantly reduces the forces required without requiring disassembly of the mold.

Another object of the invention is provision of a sectional ingot mold adapted to cause partial separation of the sections during stripping thus easing removal of the ingot without disassembly of the mold.

SUMMARY OF THE INVENTION

The instant invention provides a sectional ingot mold capable of achieving partial separation of the sections during stripping of an ingot therefrom. The mold has a plurality of sections the inner surfaces of which, when the sections are assembled together, together form an elongated generally vertical mold cavity. Usually only two mold sections are needed but any number may be used. The mold cavity determines the shape, configuration and size of an ingot formed upon solidification of molten metal poured therein. The mold cavity forms an opening in at least one end of the mold. The opening is of sufficient cross section to permit removal of an ingot formed in the cavity longitudinally through the opening. Thus, an ingot may be stripped from the mold without disassembly of the sections. The sections have juncture surfaces which together with juncture surfaces on adjacent sections form joints extending longitudinally in a direction generally parallel to the axis of the mold cavity.

Means are provided for reversibly coupling the mold sections together in assembled relation. The term reversibly, for purposes of the specification and claims herein, means the coupling device will permit separation of at least the outer juncture surfaces of the joint between adjacent mold sections when stresses occur due to molten metal being poured into the mold cavity, but that the coupling device will cause the juncture surfaces to return to their original fully abutted position when the stresses are relieved. This reversibility may be accomplished by two general types of coupling device, (a) those being generally fixed in position on the mold sections and providing reversibility solely through their elastic behavior, and (b) those providing reversibility essentially by their overall movement rather than through elastic behavior. It will be apparent that the "fixed" type must be of a certain size in relation to their physical properties in order that the elastic limit of the device will not be exceeded in service conditions, i.e., under the particular temperatures and stresses to which they were subjected. Preferably, the fixed type are composed of metal. They may extend circumferentially around the outer periphery of the mold sections. Chain, cable, or wire strand have desirable elongation characteristics for fasteners of this type, although bands, strip or plate may also be used. Conventional chains of plain carbon steel material are preferred. Alternately, the fixed metal fasteners may be of a type which act as clamps on adjacent flanged portions of the mold sections. This latter type may be in the form of C-shaped clips, or spring assemblies, including coil or other type springs mounted on bolts or pins. Finally the "movable" type coupling means may be in the form of links pivotally mounted on adjacent sections actuable by movable stripping lugs as hereinafter described.

Means are also provided for partially separating the sections in a transverse direction to ease removal of an ingot from the mold without necessitating loosening or removal of the coupling means. This reduces the forces necessary for stripping the ingots and decreases the possibility of damaging the mold. Preferably, the separating means includes a pair of stripping lugs movably mounted on opposite sides of the exterior of the mold as assembled and means coacting with said lugs for exerting force on opposite of adjacent mold sections so as to effect partial separation thereof. In one embodiment the coaction means includes at least one pair of links for such stripping lug, each link pivotally connected at one end to the lug and at the other to opposite of adjacent mold sections. In this embodiment the links may serve as coupling means for joining the mold sections. In another embodiment the coaction means includes a splice plate adapted to overlap each joint between the mold sections, means being provided for fixedly connecting the plates to one of opposite adjacent sections, and slidably connecting them to the other. Means movable with each stripping lug are adapted to engage the splice plate and force the sections apart. Finally, in a more preferred embodiment, the stripping lugs are fixedly mounted on each splice plate, the plates being movable in a vertical direction. Slidable pin and guide-track assemblies are provided for connecting the splice plate to each of opposite adjacent of the mold sections. The guidetracks are angularly aligned so as to extend from an upper end located near the joint between mold sections to a lower end remote from said joint.

Conceivably, other means may be used for separating the mold sections, with coaction with conventional stripping lugs. For example, fluid powered cylinders or screw jacks might be provided which are actuable independently of stripping means. In such cases it may be possible to control the force applied, thus limiting the separation distance. However, in some cases it is desirable to limit the separation distance by providing mechanical stop means. This is especially important where fixed metal fasteners are used so as to assure that the elastic limit of the fasteners is not exceeded during separation.

It will be apparent that separation of the sections in accordance with the invention may permit use of molds having straight walled cavities as distinguished from the conventional tapered cavity designed to facilitate stripping of the ingot from the mold. It is likely however, that in commercial practice tapered molds will still be preferred. Note should be taken that the invention is applicable to either 'big-end-up' or 'big-end-down' mold designs i.e. molds having cavities tapered to form an ingot with either a larger top or bottom end, respectively. Although not so limited, it appears preferable that the means for separating the sections translate part of stripping forces applied longitudinally to the mold sections. Thus, conventional stripping cranes may be used.

DESCRIPTION OF THE PREFERRED EMBODIMENT

Figure 1:
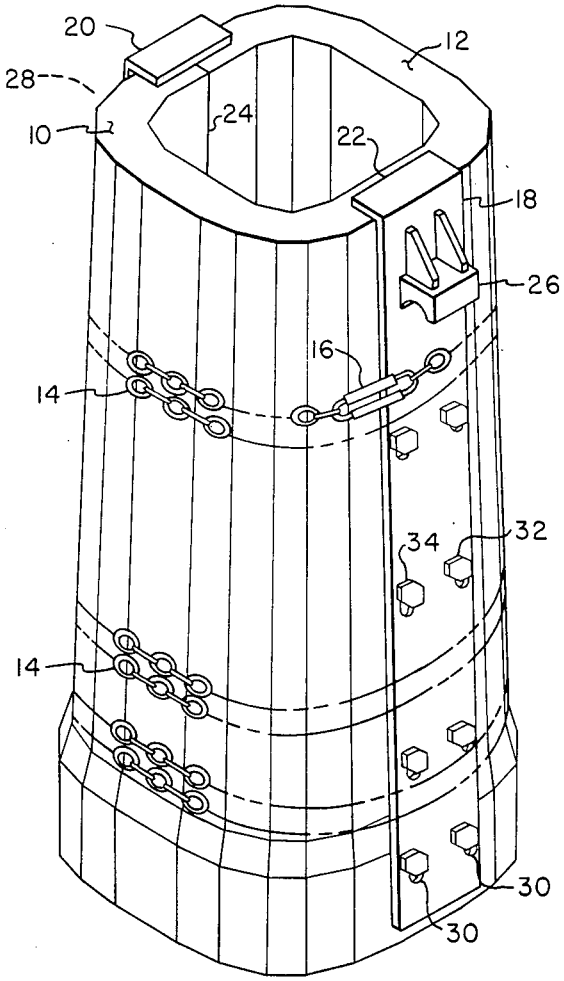
FIG. 1 is an isometric view of the mold of the instant invention.
Figure 2:
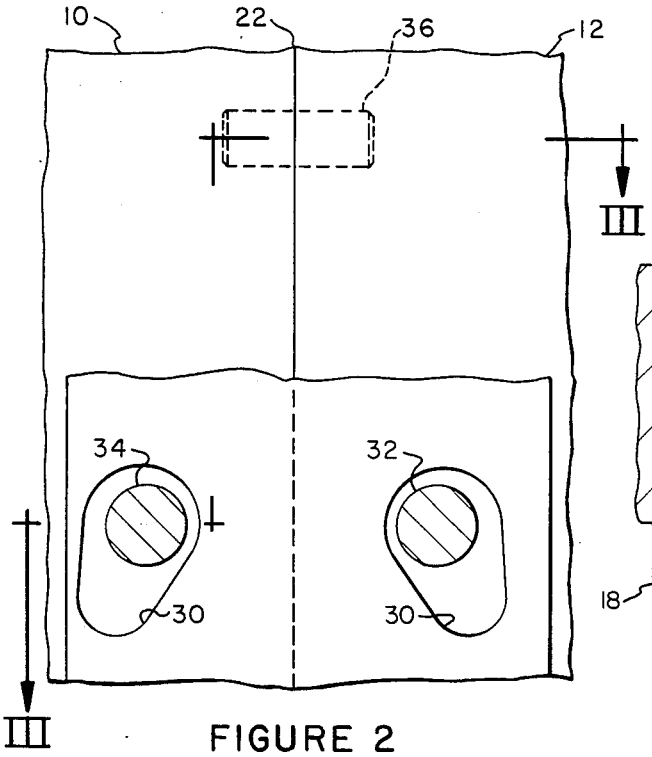
FIG. 2 is an enlarged typical partial side elevation view of the mold showing the exterior surfaces of portions of the splice plate and mold sections at the joint between mold sections.
Figure 3:
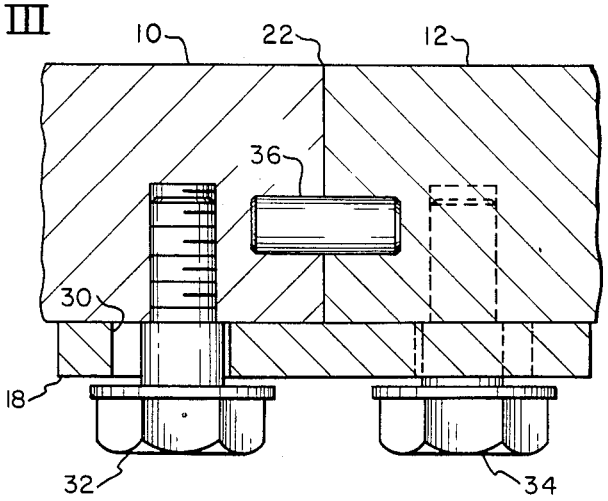
FIG. 3 is a section taken at III—III of FIG. 2.

Referring to FIG. 1 the apparatus of this invention includes longitudinal cast-iron mold sections 10, 12. A plurality of chains 14, preferably of carbon steel although they may be of other material, extend around the outer periphery of the sections and hold them in assembled position. The chain ends may be joined by any suitable device, such as connecting links, or U-bolt connectors and sleeve nuts, as shown at 16 in the drawing figure. A pair of splice plates 18, 20 are provided covering joints 22, 24 between juncture surfaces of the sections. The splice plates have stripping lugs 26, 28 respectively, adapted for engagement by a conventional stripping crane commonly used to strip ingots from one-piece ingot molds. The splice plates have a plurality of pairs of holes 30 located at different elevations. Each hole is somewhat elongated as illustrated in FIG. 2. Pins or threaded studs 32, 34 (FIGS. 1, 2 and 3) extend through holes 30 to connect the splice plates to opposite of the mold sections. One or more dowel pins 36 may be provided between sections to guide their separation. When steel is poured into the mold and begins to solidify, the mold is rapidly heated and expanded. Since the inside layers of the mold are closer to the molten steel, they are heated more than the outer layers of the mold. Thus a temperature gradient is established through the mold wall. Expansion of the mold is also greater on the inside of the mold and this will be manifest as a tapered opening of the joints with the inside surfaces remaining in contact and the outside surfaces separating. This opening of the outer edges of the joints will stretch the chains and separate pins 32, 34. Holes 30 in FIG. 2 are larger at the top to accommodate the separation of the pins. Referring again to FIG. 2 holes 30 are designed to guide movement of studs 32, 34 from an upper position relatively near the juncture surfaces, to a lower position remote from the juncture surfaces. The splice plates are slidable so that when engaged by a stripping crane, they are lifted somewhat with respect to the mold sections. As this occurs studs 32, 34 are forced outward by weight of the ingot and mold sections to the lower end of holes 30, thus partially separating the mold sections. As is readily apparent the separation distance may be limited through proper design of the spacing, size and alignment of the holes in the splice plates the lower ends of which serve as mechanical stop means. After the ingot is removed from the mold and the crane disengages from the lifting lugs, the chains pull the mold sections together.

Figure 4:
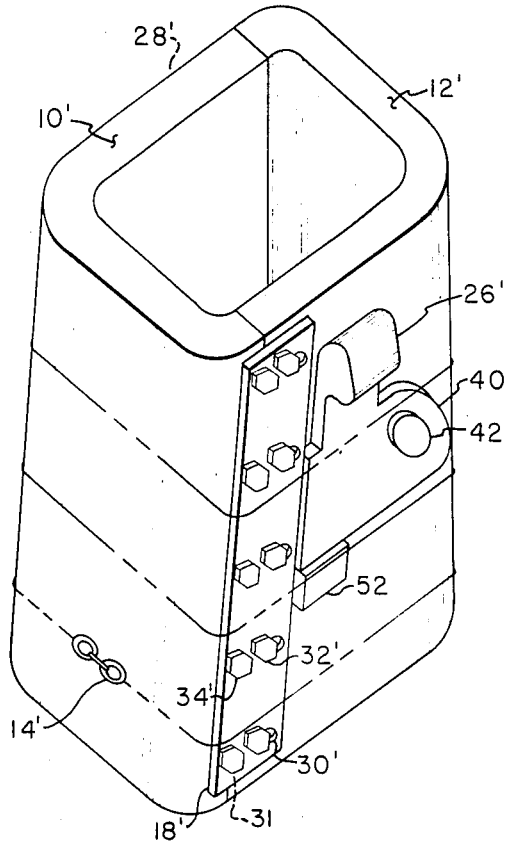
FIG. 4 is an isometric view of an alternate embodiment of the invention.

Another alternative is shown in FIG. 4. Here sections 10', 12' are joined by steel chains 14' as in the embodiment of FIG. 1. A pair of splice plates are provided one of which is illustrated at 18'. The splice plates have a plurality of holes 30' and 31 with pins or threaded studs 32', 34' mounted therein, respectively for connecting the splice plate to opposite adjacent mold sections. Holes 31 are round as distinguished from elongated shape holes 30'. Thus studs 34' fixedly secure the splice plate in position on mold section 10'. Holes 30' are elongated, but in a horizontal direction as distinguished from the angular direction of the holes in FIG. 1 with respect to the juncture surfaces. Again a pair of stripping lugs are provided 26', 28' which are movable in a 'generally' vertical direction. In this case the lugs are each pivotally mounted on a plate 40 about a pin 42. When liquid steel is poured in this mold, the mold expands more on the inside than on the outside, causing the joints to open more on the outside than on the inside. Thus the inside remains sealed to prevent the leakage of steel and the outside of the joint opens. This opening of the outside corners of the joints stretches the chains and separation of studs or pins 32' from studs or pins 34'. Later when the solidified ingot is ready to be removed from the mold, the stripping crane lifts the mold and ingot by pulling upward on lugs 26' 28'. The mounting plate 40 of each lug 26', 28' coacts with the splice plates, holes and threaded studs to exert force on opposite adjacent mold sections as the lugs are raised. Thus the mold sections are pried apart by the rotative movement of plate 40. It is apparent that the rotative motion of 40 and the separation of the mold sections may be controlled by designing the length of holes 30'. After the ingot is removed from the mold and the stripping crane is disengaged from lifting lugs 26' 28' the plate 40 will rotate until it rests on stop block 52. Tension in the chains will pull the mold sections back together.

Figure 5:
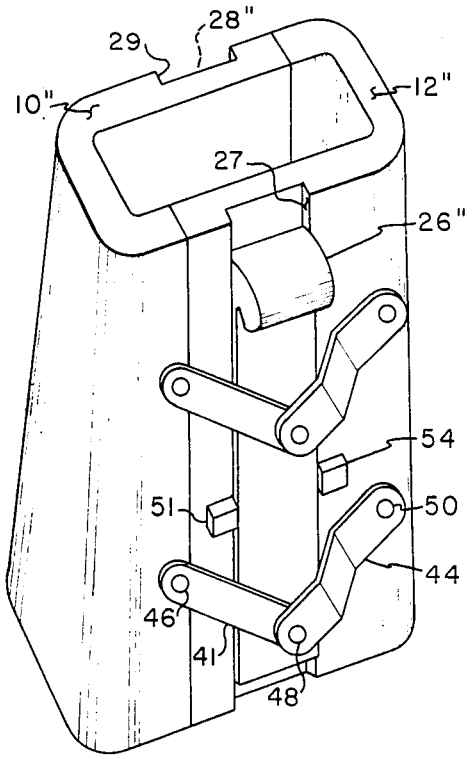
FIG. 5 is an isometric view of yet another alternate embodiment of the invention.

Finally, in FIG. 5 sections 10", 12" have stripping lugs 26", 28" mounted slidably in a vertical direction in slots 27, 29, respectively. Two pairs of links 41, 44 join the lugs to opposed adjacent sections. The links are pivotally mounted on pins 46, 48, 50. The links may serve as metal fastening means in combination with the weight of the stripping lugs exerting force tendng to push them together. Mechanical stop means are provided by blocks 51, 54 aligned so as to prevent the links from swinging past the horizontal position, thus preventing the mold sections from being pulled together by the crane. As is readily apparent chains might be added as in the embodiment of FIG. 1 to serve as fastening means.

When liquid steel is poured in the mold and the joints open as described earlier, the links and lugs will rise. When the stripping crane lifts the mold and ingot, the links and lugs will rise still farther. In the first movement of the links there is no separation of the ingot from the mold because the inside of the joints remain closed. However, in the second movement of the links caused by lifting with the lugs, the ingot is pried apart from the mold sections as the sections are pried apart from each other. After the ingot is removed from the mold and the crane disengages from the lugs, the mold sections are pulled together by the weight of the lugs and links.

I claim:

1. An ingot mold, comprising:

a plurality of mold sections assembled together so that the inner surfaces of said sections define an elongated mold cavity extending axially in a generally vertical direction, said mold cavity forming an opening of sufficient cross-section in one end of said mold to permit removal of an ingot longitudinally therethrough, said mold sections having juncture surfaces each extending longitudinally in a direction generally parallel to the axis of said mold cavity, fixed metal fastener means for reversibly coupling said mold sections together in assembled relation, means for partially separating in a transverse direction at least some of the mold sections and elastically deforming said fixed metal fastener means, creating a gap between adjoining juncture surfaces of said mold sections, and mechanical stop means for limiting the maximum separation distance between the mold sections so that the elastic limit of said fixed fastener means is not exceeded when said sections are partially separated.

2. The mold of claim 1 wherein the inner surfaces of said sections are shaped so that the mold cavity is of tapered cross section along at least a major portion of the length thereof.

3. The mold of claim 2 wherein said cavity is tapered in a direction so as to have a larger cross section at the lower end thereof.

4. The mold of claim 1 wherein said fixed metal fastener means extends circumferentially around the exterior of the assembled mold sections.

5. The mold of claim 4 wherein said separating means includes a pair of stripping lugs movably mounted on said mold sections, each of the stripping lugs in said pair being located on opposite sides of the exterior of said mold, and means for coaction with said stripping lugs upon movement thereof so as to exert force on opposite adjacent mold sections in order to effect the partial separation of said mold sections.

6. The mold of claim 4 wherein the fixed fastener means comprises a plurality of chains located at spaced locations on the assembled mold sections.

* * * * *